US005568757A

United States Patent [19]

Lewis

[11] Patent Number: 5,568,757

[45] Date of Patent: Oct. 29, 1996

[54] SOCKET WRENCH ADAPTER

[76] Inventor: Kenneth J. Lewis, Rte. 4 311 Avenue B, Brazoria, Tex. 77422

[21] Appl. No.: 367,831

[22] Filed: Jan. 3, 1995

[51] Int. Cl.[6] ..... B25B 23/16

[52] U.S. Cl. ..... 81/177.2; 81/177.85

[58] Field of Search ..... 81/177.1, 177.2, 81/177.85

[56] References Cited

U.S. PATENT DOCUMENTS 3,875,829 4/1975 Evans et al. ..... 81/177.2 X
4,317,393 3/1982 Graffam ..... 81/177.2
4,754,670 7/1988 Raymond ..... 81/177.2
4,781,085 11/1988 Fox, III ..... 81/177.85
4,825,733 5/1989 Chinchar ..... 81/177.2

*Primary Examiner*—D. S. Meislin

[57] ABSTRACT

A socket wrench adapter having a first end and a second end in axial and opposing alignment as a unitary structure, the first end having a square projection of a size to fit into a matching hole in a socket wrench for the purpose of transmitting a turning force to the socket wrench, and the second end having a projection with a polygonal bore and a polygonal exterior surface is described. The adapter is useful as a means for applying a turning force to a socket wrench when a normally used ratchet crank cannot be used.

1 Claim, 2 Drawing Sheets

SOCKET WRENCH ADAPTER

FIELD OF THE INVENTION

Socket wrench adapters turnable by a releasably attached ratchet or crank handle or other releasable turning force.

BACKGROUND OF THE INVENTION

Socket wrenches of various sizes are well known and usually are sold as a kit or set of various sizes for operation with bolts and nuts of various sizes. Such socket wrenches have square openings in one end for receiving a crank, usually a ratcheting crank. Cranks other than ratcheting cranks are often used (as well as other cranks), such as drill-bit cranks, to turn the socket wrenches. Ratcheting cranks are often used as well as other cranks, such as drill-bit cranks, to turn the socket wrenches. At times there is encountered a nut or bolt which needs to be loosened by a socket wrench, but which cannot be loosened by a ratcheting crank, or other crank, which has become ineffective in performing that operation for one reason or another, or which may have been lost or temporarily misplaced.

If a very tight nut or bolt has become substantially "frozen" in place, it is possible for a ratchet crank, or other crank, to break or strip, especially if it is an old, often used crank. When that happens, the turning of the socket is usually difficult, if not impossible, especially if the square opening in its crank-receiving end has been worn badly and is almost round, allowing slippage of the crank device.

It is an object of this invention to provide alternate means for a socket wrench to receive a cranking tool for operation of the socket wrench in loosening or tightening a nut or bolt or other such device to which it may be applied for the purpose of turning it either clockwise or counterclockwise, as the situation requires.

It is a further object to provide extensions for use between a socket wrench and a crank device, said extensions being operable for use between, and connecting said socket wrench and said crank device, having a square rod end suitable for insertion into a socket wrench and with an annular opening in its other end in axial alignment with the said insertion end, the said opening being adaptable for receiving a cranking device, and at the same end having a polygonal configuration on the exterior of the body of the wrench which has the said annular opening.

SUMMARY OF THE INVENTION

A problem is encountered when the primary loosening mechanism used for turning socket wrench adapters becomes ineffective or inadequate because of being worn or broken or lost. The problem is alleviated by the present novel means of having a secondary wrench-fitting feature built as part of the socket wrench adapter whereby an alternate cranking or turning force can be applied to turn the socket wrench. The secondary wrench-fitting feature comprises a circumferential polygonal surface on the outer perimeter of the socket wrench for engagement of a wrench having cooperating and opposing surfaces which fit substantially snugly against at least two of the polygonal surfaces whereby a leverage applied to the wrench is transmitted to the polygonal surfaces, tending to turn the socket wrench in the direction of the leverage. The adapters can be made in numerous sizes and lengths, in metric or non-metric units.

BRIEF DESCRIPTION OF DRAWINGS

FIG. 1*a* is an end view of the device,shown in side view in FIG. 1*b* and is the opposite end of the FIG. 1*c* view of FIG. 1*b*.

FIG. 2 is a perspective of a adapter device, such as is shown in FIGS. 1*a*, 1*b*, and 1*c*.

FIGS. 3*a* and FIG. 3*b* shows a side view and one end view of an embodiment of a construction of the adapter device of FIG. 1*a*–1*c* and 2, except that the unitary body construction is shown as being extended to position the ends farther apart.

FIG. 4 provides a view of the unitary adapter device to illustrate embodiments in which the length is illustrated as being indefinite and to show a length extender as being round, but having a polygonal feature as part of the extender to which an open-end wrench can be applied.

DETAILED DESCRIPTIONS INCLUDING BEST MODE CONTEMPLATED

Figure 1A:
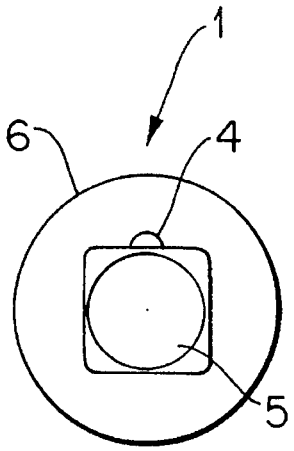
FIG. 1*a*, FIG. 1*b*, FIG. 1*c*, FIG. 2, FIG. 3*a*, FIG. 3*b*, and FIG. 4, none of which are drawn to any particular dimensions or scale, are provided as visual aids for relating the present novel socket wrench adapter device in its various forms.
Figure 1B:
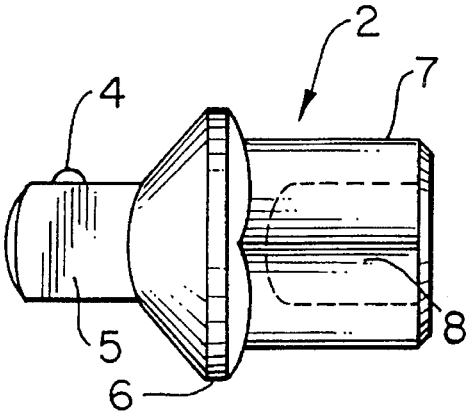
Figure 1C:
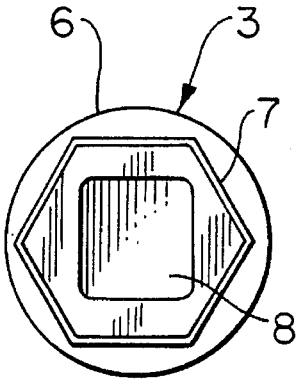

FIG. 1*b* is a side view of an example of an adapter of the present disclosure, shown generally the number 2, said side view being taken with end views (FIGS. 1*a* and 1*c*) of each end of adapter 2 for connecting a ratchet wrench to a socket wrench whereby the square end 5, which has a detent 4, is insertable into a socket wrench which has a receiving hole of appropriate size for mating with the square end 5, the detent 4 serving to releasably hold the square end in place in the receiving hole (which is not shown). In FIG. 1*a*–1*c* the body 6 shows the unitary construction of a hexagonal wrench receiver 7, with a bore 8 having a square cross section, at one end, and a square rod 5 projecting from 6 as the other end. The square rod projection 5 preferably has a detent 4 (preferably of the spring and ball type) built into it as a means for retaining the union of the projection 5 into a socket wrench hole of the same size, but which permits a person to pull it out. Such detents are well-known and widely used in the tool industry. Other releasable holders may be employed, if desired. The end view shown generally in FIG. 1*a* by the number 1, shows the square projection end (5) and also shows the detent (4). The number 3 in FIG. 1*c* indicates an end view of the body 6, an end view of the hexagonal 7, and an end view of the square bore 8 of FIG. 1*c*. Square projection 5 of FIGS. 1*a* and 1*b* with its detent 4 is for insertion into a socket wrench of the appropriate matching size. Square bore 8 of FIGS. 1*b* and 1*c* is for receiving a ratchet wrench, an Allen wrench, or a drill-crank or other cranking device, but if that type of crank is not available or is broken or too worn to be effective, then a wrench can be applied to the outside of the hexagonal portion in order to apply the turning force desired for turning the socket wrench.

Figure 2:
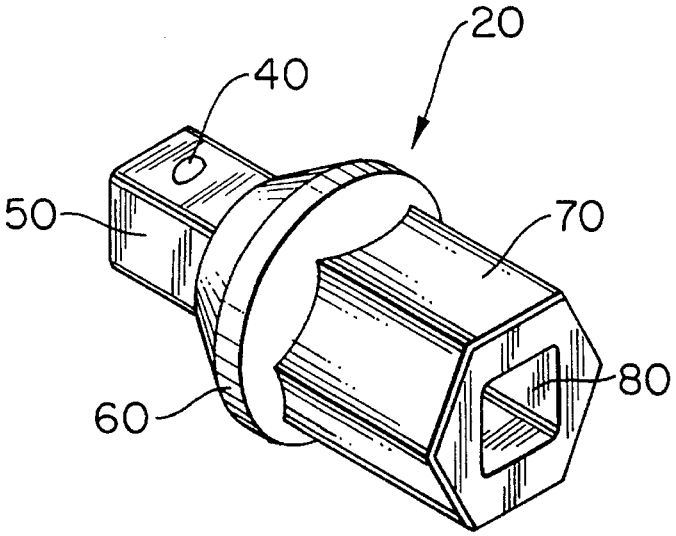

FIG. 2 shows a view of the socket wrench adapter, indicated generally by the number 20, and shows body 60, square projection 50, detent 40, hexagonal portion 70, and bore 80.

Figure 3A:
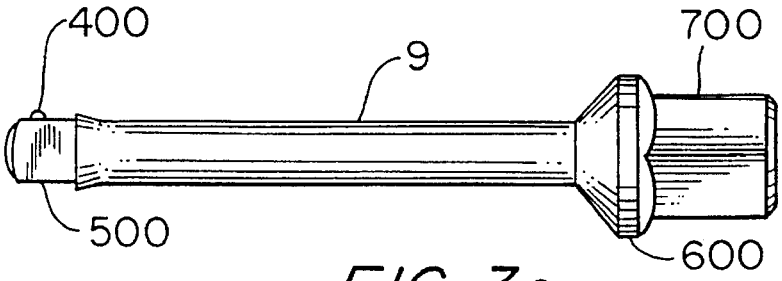
Figure 3B:
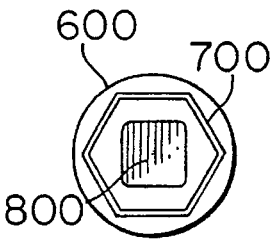

FIGS. 3*a* and 3*b* show a side view and end view, respectively, of the socket adapter and a view of one end with body 600, hexagonal portion 700, bore 800, square projection 500, and detent 400, and, in addition, shows an extender portion 9 used in making the device longer, which is important for obvious reasons.

Figure 4:
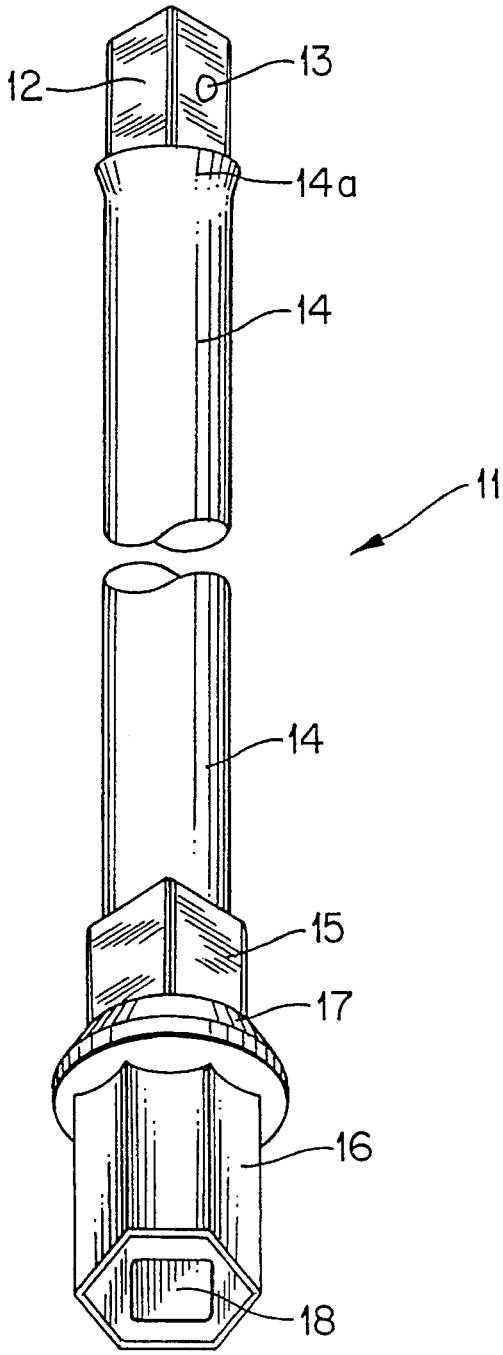

FIG. 4 shows a view of an embodiment, shown generally by the number 11, in which an extender 14 is provided between a first end 12, and a second end 16, with intermediate feature 15 which is shown as being square. The first end 12 is shown as being square and with a detent 13 provided there; other polygonal shapes are possible at the first end, but the customary shape would be square. The customary detent is a small ball with a hidden spring compressed against it: such detent devices are quite common, though other means of providing releasable attachment of the device into a socket wrench may be used. Also in FIG. 4 there is shown a square bore 18 inside second end 16 which is hexagonal in cross-section; this is useful for using a ratchet crank or other cranking (turning) means, such as an Allen wrench. In the body of the adapter there is shown portion 17 which provides a stop means of keeping in place a wrench applied to hexagonal portion 16 or applied to square portion 15. There is a stop means 14*a*, which is a flared portion of extender 14 at the juncture with square end 12, which prevents the square from reaching deeper into a socket wrench when inserted therein.

The lengths of the adapters of the present disclosure can vary over a wide range whether made in metric units or non-metric units. The size of the square projection intended for operation by being inserted into a socket wrench can also vary over a very wide range. The size of the hexagonal wrench portion can vary over a wide range, and when the extender is being operated by an open-end wrench, crescent wrench, closed-end wrench, or different size socket wrench with ratchet, it need not be of the same units of measurement as the square projection on the other end of the extender, or of the square bore inside of it.

Whereas the above descriptions have dealt with square configurations and hexagonal configurations for the wrench engagements, and those are generally the most preferred configurations, the device can be made with other configurations, though configurations made with only 3 sides would not be expected to be engageable with commonly known wrench cranks.

Thus the described "square" bore is only one of several possible polygonal bores, especially those from 4 to 8 sides, preferable from 4 to 6. Likewise, the described "hexagonal" portions can also be of polygonal shapes, especially from 4 to 10 sides, preferably 4 to 8, most preferably 4 to 6.

As to the "square" projection of the device which is intended for insertion into a socket wrench, the most preferred polygonal shape is square since that is the usual shape of the socket wrench which receives an inserted cranking device for tightening or loosening. If there be socket wrenches having crank-receiving holes which are not square, then one can prepare a socket wrench adapter in accordance with this disclosure that would work with that socket wrench.

In this disclosure, the term "crank" is used to signify a tool that uses leverage or twisting motion to obtain a turning motion.

It is apparent in the drawings that the polygonal wrench engagement ends are in axial alignment along the unitary body, aligned concentrically along the axis. The parts of the unitary body are obviously in fixed position relatively to each other.

In accordance with the manufacture of tools, the selection of materials should be made on the basis of which grade of tool steel is appropriate. Usually the best available grade is the preferred material.

The present invention is limited only by the scope accordable to the claims appended, and others, learning of the present invention may construct devices which differ in some manner from the embodiments disclosed here without departing from the scope of these claims.

What is claimed as the invention is:

1. A unitary socket wrench adapter comprising a first end portion and a second end portion in axial and opposing alignment to form a unitary body, said first end and second end portions concentrically aligned along the axis, with all the parts of the unitary body in fixed position relative to each other, said first end portion having a four-sided projection, one of which sides contains a detent, said projection operable for insertion into a socket wrench for applying turning force thereto, said second end portion having a hexagonal projection containing a four-sided bore extending therein to a depth suitable for receiving a crank, the sides of said four-sided bore being parallel to the sides of the said hexagonal projection, said hexagonal projection of the second end portion operable to receive the cranking force of a wrench applied to the external surface thereof, further characterized by an extender section between the first end portion and the second end portion and by a flared circumference where the extender section connects with the said first end portion, and further characterized by a square section in concentric axial alignment on the extender section where the extender section connects to the second end portion.

* * * * *